US005637071A

United States Patent [19]

Simmons et al.

[11] Patent Number: 5,637,071

[45] Date of Patent: Jun. 10, 1997

[54] DISPENSING TABLE FOR A CUSHIONING CONVERSION MACHINE

[75] Inventors: James A. Simmons, Painesville Township; James E. Tekavec, Willoughby, both of Ohio

[73] Assignee: Ranpak Corp., Concord Township, Ohio

[21] Appl. No.: 109,124

[22] Filed: Aug. 19, 1993

[51] Int. Cl.[6] ..... B31F 1/10; B65B 63/00; B65B 67/00

[52] U.S. Cl. ..... 493/464; 53/390; 53/238; 53/472; 493/967

[58] Field of Search ..... 53/472, 238, 390, 53/255, 237, 240, 157, 156, 155, 154; 493/967, 464

[56] References Cited

U.S. PATENT DOCUMENTS

| | | | |
|---|---|---|---|
| 1,628,927 | 5/1927 | Stack | 53/255 X |
| 3,509,797 | 5/1970 | Johnson | 53/472 X |
| 3,603,216 | 9/1971 | Johnson | 93/1 WZ |
| 3,613,522 | 10/1971 | Johnson | 93/1 |
| 3,650,877 | 3/1972 | Johnson | 161/47 |
| 4,026,198 | 5/1977 | Ottaviano | 493/967 X |
| 4,109,040 | 8/1978 | Ottaviano | 493/967 X |
| 4,237,776 | 12/1980 | Ottaviano | 493/382 |
| 4,557,716 | 12/1985 | Ottaviano | 493/967 X |
| 4,619,104 | 10/1986 | Germunson | 53/390 X |
| 4,650,456 | 3/1987 | Armington | 493/967 X |
| 4,699,609 | 10/1987 | Komaransky, et al. | 493/357 |
| 4,717,613 | 1/1988 | Ottaviano | 428/129 |
| 4,750,896 | 6/1988 | Komaransky et al. | 493/967 |
| 4,884,999 | 12/1989 | Baldacci | 493/439 |
| 4,968,291 | 11/1990 | Baldacci et al. | 493/354 |
| 4,999,975 | 3/1991 | Wilden et al. | 53/472 X |
| 5,123,889 | 6/1992 | Armington | 493/346 |
| 5,322,477 | 6/1994 | Armington et al. | 493/967 X |

OTHER PUBLICATIONS

Bourquin verpackungs technik ag Brochure dated Jun. 1992.

*Primary Examiner*—James F. Coan

*Attorney, Agent, or Firm*—Renner, Otto, Boisselle & Sklar

[57] ABSTRACT

A cushioning conversion machine (20) and a dispensing table (100), in combination, are provided. The dispensing table (100) includes a substantially horizontal work platform (102) which includes an opening (109). The cushioning conversion machine (20) is mounted to the table (100) in such a manner that the cushioning product is deposited on the work platform (102) during operation of the machine. In this manner, a worker may conveniently place the cut section in a shipping case, or box, to fill any voids and/or to cushion an item during the shipping process.

16 Claims, 5 Drawing Sheets

DISPENSING TABLE FOR A CUSHIONING CONVERSION MACHINE

FIELD OF THE INVENTION

This invention relates generally as indicated to a dispensing table for a cushioning conversion machine. More particularly, the dispensing table is designed so that during operation of the machine, the cushioning product will be deposited on a work platform. In this manner, a worker may conveniently place the cut section in a shipping case, or box, to fill any voids and/or to cushion an item during the shipping process.

BACKGROUND AND SUMMARY OF THE INVENTION

In the process of shipping an item from one location to another, a protective packaging material is typically placed in the shipping case, or box, to fill any voids and/or to cushion the item during the shipping process. Some conventional commonly used protective packaging materials are plastic foam peanuts and plastic bubble pack. These plastic materials are usually discharged from dispensers integrated into packaging systems. In many packaging systems the set-up may allow, or even demand, horizontal dispersement of the plastic protective material. In other packaging systems, vertical dispersement of the protective material may be necessary. The plastic foam peanuts and plastic bubble pack and the dispensers of this plastic material have, for the most part, been compatible with a variety of packaging systems.

Despite this wide range of compatibility, conventional plastic protective materials are not without disadvantages. For example, one drawback of plastic bubble film is that it usually includes a polyvinylidene chloride coating. This coating prevents the plastic film from being safely incinerated, which sometimes creates disposal difficulties. Additionally, both the plastic foam peanuts and the plastic bubble pack have a tendency to generate a charge of static electricity attracting dust from the surrounding packaging site. Also, these plastic materials sometimes themselves produce a significant amount of packaging "lint". These dust and lint particles are generally undesirable and may even be destructive to sensitive merchandise such as electronic or medical equipment.

However, perhaps the most serious drawback of plastic bubble wrap and/or plastic foam peanuts is their effect on our environment. Quite simply, these plastic packaging materials are not biodegradable and thus they cannot avoid further multiplying our planet's already critical waste disposal problems. The non-biodegradability of these packaging materials has become increasingly important in light of many industries adopting more progressive policies in terms of environmental responsibility.

These and other disadvantages of conventional plastic packaging materials have made paper protective packaging material a very popular alterative. Paper is biodegradable, recyclable and renewable; making it an environmentally responsible choice for conscientious industries. Additionally, paper may be safely incinerated by the recipients of the products. Furthermore, paper protective packaging material is perfect for particle-sensitive merchandise, as its clean dust-free surface is resistant to static cling.

While paper in sheet form could possibly be used as a protective packaging material, it is usually preferable to convert the sheets of paper into a relatively low density pad-like cushioning dunnage product. This conversion may be accomplished by a cushioning conversion machine, such as that disclosed in U.S. application Ser. Nos. 07/840,306; 07/840,306; 07/712,203 (now U.S. Pat. No. 5,123,889); and 07/592,572. (These applications are all assigned to the assignee of the present application.) Such a cushioning conversion machine converts sheet-like stock material, such as paper in multi-ply form, into cut sections of a relatively low density pad-like cushioning product. A thirty-inch roll of three-ply thirty pound kraft paper, which is approximately 450 feet long, will weigh about 35 pounds and will provide cushioning equal to approximately four fifteen cubic foot bags of plastic foam peanuts while at the same time requiring less than one-thirtieth the storage space.

The machine includes a stock supply assembly, a forming assembly, a pulling/connecting assembly a cutting assembly, and a post-cutting constraining assembly, all of which are mounted on a machine frame. The machine frame includes a base plate, a first end plate which extends generally perpendicular from the upstream end of the end plate, and a second end plate which extends generally perpendicular from the downstream end of the base plate. The frame base plate and the two frame end plates together form a "C" shaped structure whereby one side of the frame base plate is a smooth uninterrupted surface. Preferably, the frame end plates are approximately 34 inches wide and approximately 12 inches tall.

The present invention provides a dispensing table on which a cushioning conversion machine may be mounted. During operation of the machine, the cushioning product will be deposited on the work platform. In this manner, a worker may conveniently place the cut section in a shipping case, or box, to fill any voids and/or to cushion an item during the shipping process.

More particularly, the present invention provides, in combination, a dispensing table and a cushioning conversion machine. The dispensing table includes a substantially horizontal work platform. The cushioning conversion machine includes conversion assemblies which convert sheet-like stock material into a cushioning product and which are mounted on the machine's frame. The cushioning conversion machine is mounted to the table in such a manner that the cushioning product is deposited on the work platform during operation of the machine. The height of the work platform is preferably between two and five feet and, more preferably, approximately three feet.

In one embodiment of the invention, the cushioning conversion machine is mounted to the table in a substantially horizontal orientation. In other words, an axis from the upstream end to the downstream end of the machine's frame is substantially horizontal. In this embodiment, the cushioning conversion machine is mounted below the work platform, and the final outlet of the machine, through which the cushioning product emerges, is aligned with an opening in the work platform. In the preferred form of this embodiment, the exit opening of the post-cutting constraining assembly is the final outlet of the machine. Additionally, the overall geometry of the post-cutting constraining assembly approximates a 90° arc and the exit opening is positioned in a generally horizontal plane.

In another embodiment of the invention, the machine is mounted to the table in a substantially vertical orientation and a downstream portion of the cushioning conversion machine extends through an opening in the work platform. In the preferred form of this embodiment, a deflector is mounted adjacent the exit opening of the post-cutting constraining assembly which encourages the cut section to be deposited on the appropriate portion of the work platform. Additionally, a separate stock supply cart, instead of the machine's stock supply assembly, is used to support/dispense the stock material during operation of the machine. Such a stock supply cart would preferably include rod-supporting brackets which are coupled to the cart's support structure and which cradle a support rod for the stock material.

These and other features of the invention are fully described and particularly pointed out in the claims. The following descriptive annexed drawings set forth in detail certain illustrative embodiments. However, these embodiments are indicative of but a few of the various ways in which the principles of the invention may be employed.

DETAILED DESCRIPTION

Figure 1:
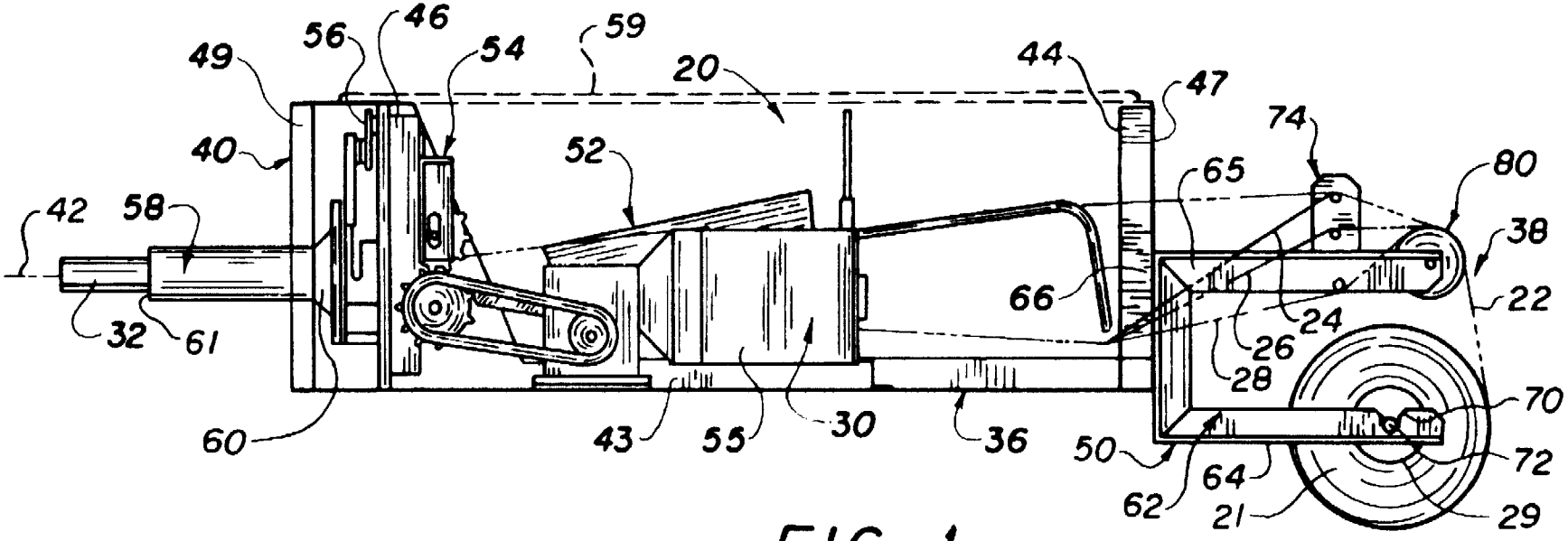
FIG. 1 is a side view of a cushioning conversion machine.

Referring now to the drawings in detail and initially to FIG. 1, a cushioning conversion machine according to the present invention is indicated generally at 20. In FIG. 1, the machine 20 is shown positioned in a horizontal manner and loaded with a roll 21 of sheet-like stock material 22. The stock material 22 may consist of three superimposed webs or layers 24, 26, and 28 of biodegradable, recyclable and reusable thirty-pound Kraft paper rolled onto a hollow cylindrical tube 29. The machine 20 converts the stock material 22 into a continuous unconnected strip having lateral pillow-like portions separated by a thin central band. This strip is connected or coined along the central band to form a coined strip which is cut into sections 32 of a desired length. The cut sections 32 each include lateral pillow-like portions separated by a thin central band and provide an excellent relatively low density pad-like product which may be used instead of conventional plastic materials.

The machine 20 includes a frame, indicated generally at 36, having an upstream or "feed" end 38 and a downstream or "discharge" end 40. The terms "upstream" and "downstream" in this context are characteristic of the direction of flow of the stock material 22 through the machine 20. In FIG. 1, the frame 36 is positioned in a substantially horizontal manner whereby an imaginary longitudinal line or axis 42 from the upstream end 38 to the downstream end 40 would be substantially horizontal.

The frame 36 is formed from a base plate 43 and two end plates 44 and 46. The frame base plate 43 is generally rectangular and extends from the upstream end 38 to the downstream end 40 of the frame 36 in a generally horizontal plane. Although not perfectly apparent from the illustration, the first or upstream frame end plate 44 may be more specifically described as a thin rectangular wall having a rectangular stock inlet opening passing therethrough. The second or downstream frame end plate 46 is generally rectangular and planar and includes a relatively small rectangular outlet opening.

The first frame end plate 44 extends generally perpendicular in one direction from the upstream end of the frame base plate 43. In FIG. 1, this direction is upward. The second end plate 46 is preferably aluminum and extends in generally the same perpendicular direction from the downstream end of the frame base plate 43. In this manner, the frame 36 is basically "C" shaped and one side of the frame base plate 43, which in the illustrated embodiment is the lower side, is a flat uninterrupted surface. The frame 36 also includes a box-like extension 49 removably attached to a downstream portion of the base plate 43.

In the preferred embodiment, the frame 36 is dimensioned so that the length of the machine 20 is approximately 56 inches; the width of the machine is approximately 34 inches; and the height of the machine is approximately 12 inches. The "length" of the machine is measured from its downstream end to its upstream end and thus the length is defined by the frame base plate 43 and the extension 49. The "width" of the machine is the transverse dimension of the frame base plate 43; and the "height" of the machine is defined by the frame end plates 44 and 46. These dimensions reflect a machine roughly one-third the size of conventional conversion machines.

The machine 20 further includes a stock supply assembly 50, a forming assembly 52, a gear assembly 54 powered by a gear motor 55, a cutting assembly 56 powered by a cutter motor 57, and a post-cutting constraining assembly 58; all of which are mounted on the frame 36. The stock supply assembly 50 is mounted to an upstream side of the first frame end plate 44. The forming assembly 52 is located downstream of the stock supply assembly 50 and is mounted on an intermediate portion of the frame base plate 43. The gear assembly 54 is located downstream of the forming assembly 52 and is mounted on an upstream side of the second frame end plate 46. On the opposite downstream side of the frame end plate 46, the cutting assembly 56 is mounted. The motors 55 and 57 are mounted on the frame base plate 43 at about the same level as the forming assembly 52 and on opposite sides thereof. Finally, the post-cutting constraining assembly 58 is located downstream of the cutting assembly 56 and is mounted on the box-like extension 49. The assemblies/motors mounted on the frame end plate 46 may be enclosed by a sheet metal housing 59 which is shown in phantom in FIG. 1.

In operation of the machine 20, the stock supply assembly 50 supplies the stock material 22 to the forming assembly 52. The forming assembly 52 causes inward rolling of the lateral edges of the sheet-like stock material 22 to form the lateral pillow-like portions of the continuous strip. The gear assembly 54 actually performs dual functions in the operation of the machine 20. One function is a "pulling" function in which the paper is drawn through the nip of two cooperating and opposed gears of the gear assembly whereby the gear assembly 54 is the mechanism which pulls the stock material 22 from the stock roll 21, through the stock supply assembly 50, and through the forming assembly 52. The second function performed by the gear assembly 54 is a "coining" or "connecting" function. Specifically, the gear assembly 54 connects the strip by coining its central band to form the coined strip. Thus the gear assembly 54 may be viewed as the pulling/connecting assembly of the machine 20.

As the coined strip travels downstream from the gear assembly 54, the cutting assembly 56 cuts the coined strip into sections 32 of a desired length. These cut sections 32 then travel through the post-cutting constraining assembly 58. It may be noted for future reference that in the machine 20 shown in FIG. 1, the entrance opening 60 and the exit opening 61 of the post-cutting constraining assembly 58 are aligned. Also, although not perfectly apparent from the drawing, the entrance opening 60 and the exit opening 61 are aligned with the outlet opening in the downstream frame end plate 46. In any event, the exit opening 61 of the post-cutting constraining assembly 58 is the final outlet through which the cushioning product emerges.

The stock supply assembly 50 includes two laterally spaced brackets 62. The brackets 62 are each generally shaped like a sideways "U" and have two legs 64 and 65 extending perpendicularly outward from a flat connecting base wall 66. Both of the legs 64 have open slots 70 in their distal end to cradle a supply rod 72. The supply rod 72 is designed to extend relatively loosely through the hollow tube 29 of the stock roll 21. As the stock material 22 is pulled through the machine 20 by the gear assembly 54, the tube 29 will freely rotate thereby dispensing the stock material 22. A pin (not shown) may be provided through one or both ends of the supply rod 72 to limit or prevent rotation of the supply rod 72 itself.

The other legs 65 of the U-brackets 62 cooperate to mount a sheet separator 74 which includes three horizontally spaced relatively thin cylindrical separating bars. The number of separating bars, namely three, corresponds to the number of paper layers or webs of the stock material 22. The sheet separator 74 separates the layers 24, 26 and 28 of paper prior to their passing to the forming assembly 52. The bracket legs 65 also cooperate to support a constant-entry bar 80 which is rotatably mounted on the distal ends of the legs. The bar 80 provides a nonvarying point of entry for the stock material 22 into the separator 74 and the forming assembly 52, regardless of the diameter of the stock roll 21. Thus, when a different diameter roll is used and/or as dispensation of the stock material 22 from roll 21 decreases its diameter, the point of entry of the stock material 22 into the separator 74 remains constant.

Figure 2:
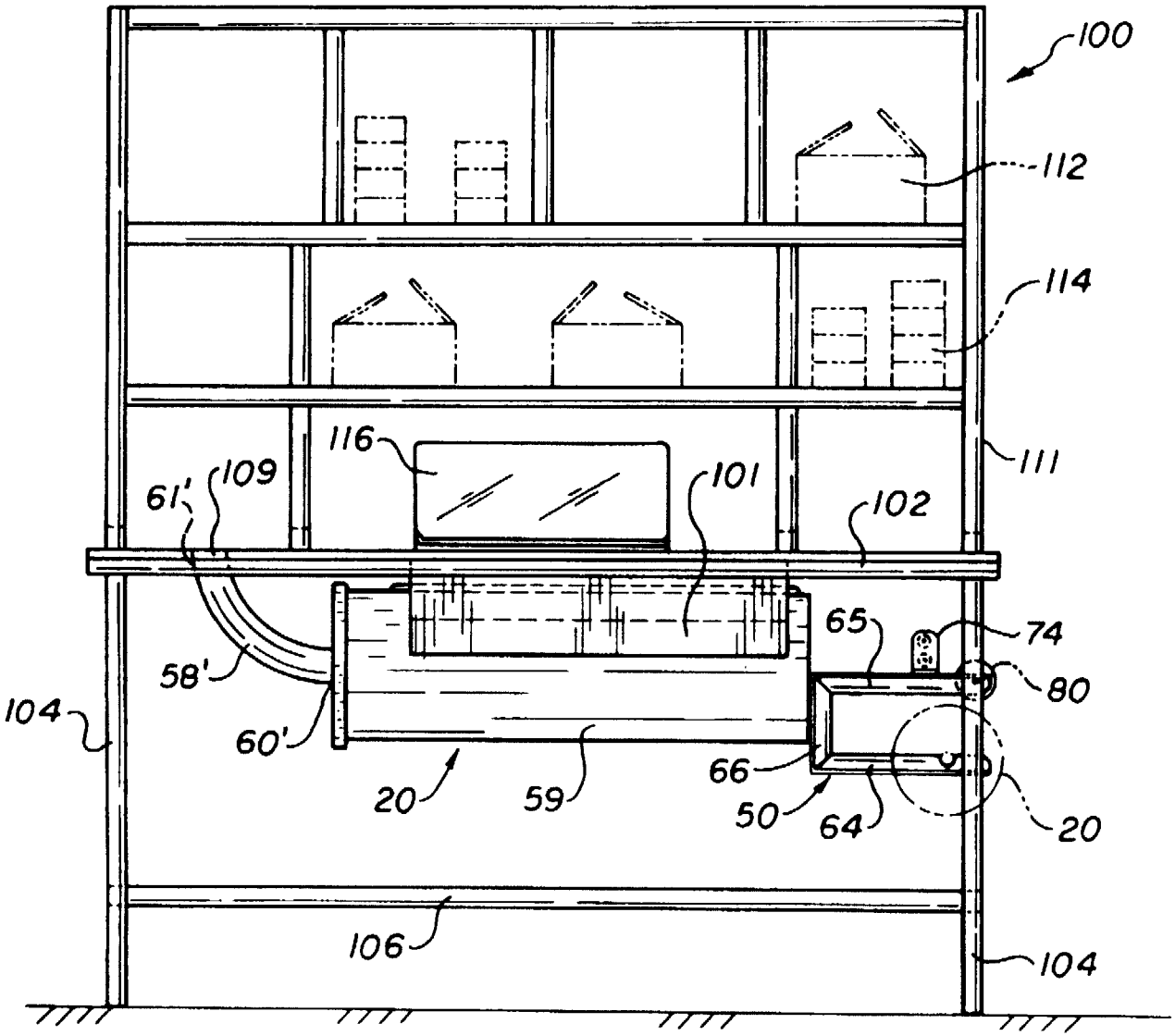
FIG. 2 is a front view of a dispensing table according to one embodiment of the invention, the table being shown with a cushioning conversion machine mounted thereon in a horizontal orientation.
Figure 3:
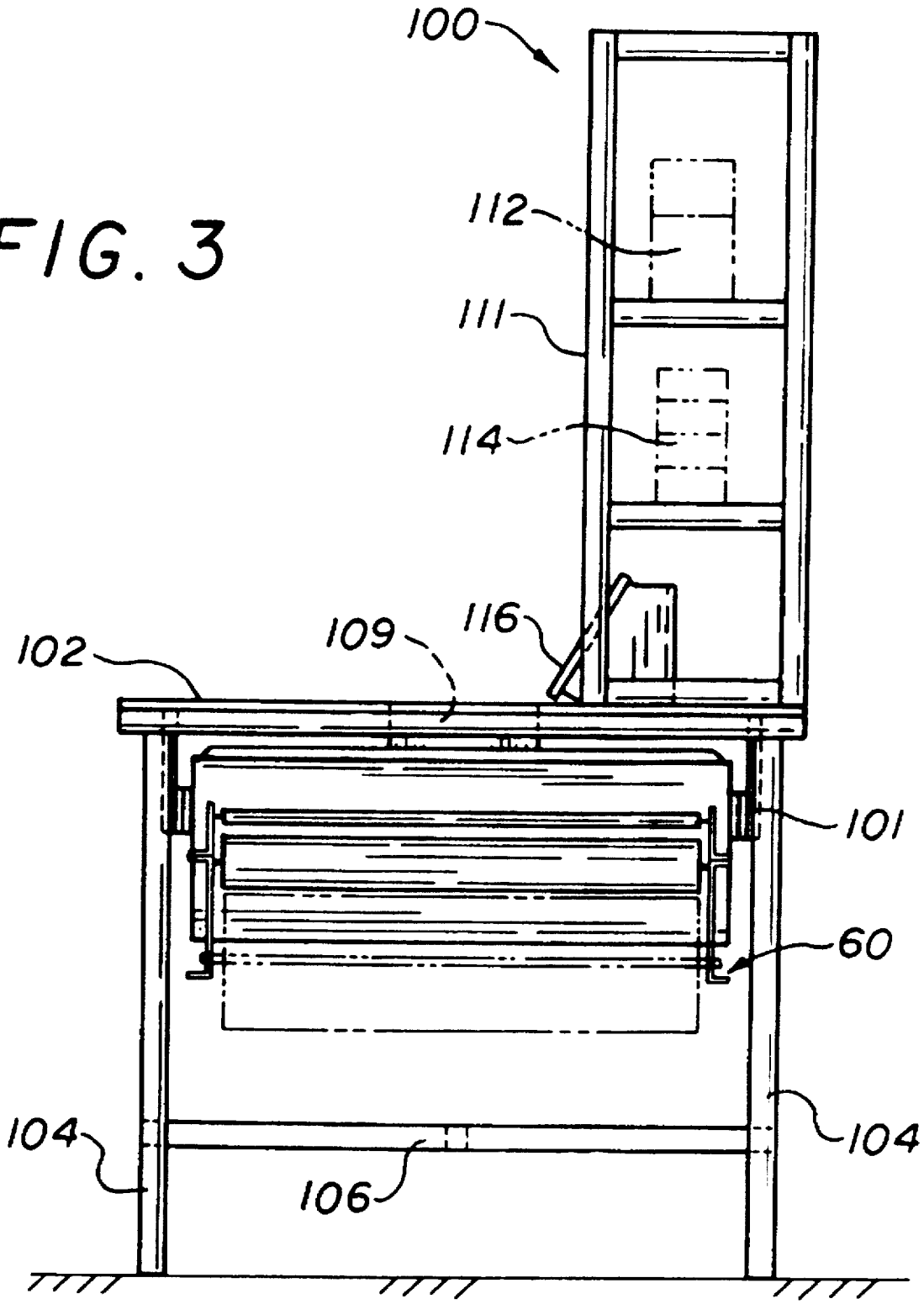
FIG. 3 is a side view of the dispensing table and the horizontally mounted cushioning conversion machine.

Turning now to FIGS. 2–3, a dispensing table 100 according to the present invention is shown, with a cushioning conversion machine 20 mounted thereon in a horizontal orientation via a mounting brace 101. The machine 20 is essentially identical to that shown in FIG. 1 except that it includes a modified form 58' of the post-cutting constraining assembly. Specifically, the overall geometry of the post-cutting constraining assembly 58' approximates a generally 90° curved arc. Thus, the entrance opening 60' is aligned with the outlet opening in the downstream frame end plate 46, both of these openings being positioned in a generally vertical plane. However, the exit opening 61' of the post-cutting constraining assembly 58' is positioned in a generally horizontal plane. As is explained in more detail below, this positioning of the exit opening 61' allows the cut section of cushioning dunnage material to be deposited in a convenient location on the table 100.

The table 100 includes a work platform 102 supported by a series of vertical and horizontal support members. The table 100 is designed so that the work platform 102 is at a convenient height for a worker performing packaging duties. Preferably, the height of the work platform 102 is between two and five feet. More preferably, the height of the work platform 102 is approximately three feet.

The support members may be of a variety of forms provided that an appropriate cavity is provided just below the work platform 102 for the mounting of the machine 20. In the illustrated embodiment, the support members comprise four vertical support members 104 and four horizontal support members 106 which interconnect the vertical support members 104. As is best seen in FIG. 3, this arrangement of the support members provides a cavity 108, below the work platform 102, for the machine 20.

The machine 20 is mounted below the work platform 102. More specifically, the frame base plate 43 is positioned adjacent and parallel to the lower surface of the work platform. (Thus, the orientation of the machine 20 in FIGS. 2–3 is inverted when compared to the orientation of the machine in FIG. 1.) One may appreciate that the basically "C" shape of the frame 36, and the flat uninterrupted upper surface of the frame base plate 43, allows such a mounting arrangement. Additionally, the sizing of the frame 36, and the arrangement of the cushioning assemblies thereon, allows the machine 20 to be mounted in this manner.

The work platform 102 includes an opening 109 through which the downstream end of the post-cutting constraining assembly 58' extends. In this manner, as a cut section emerges from the exit opening 61' of the post-cutting constraining assembly 58', it will be deposited on the work platform 102. A worker may then conveniently place the cut section in a shipping case, or box, to fill any voids and/or to cushion an item during the shipping process.

The table 100 may additionally include a shelf unit 111 mounted on rear portion of the work platform 102. This shelf unit 111 may used to store appropriate packaging materials, such as boxes 112 and/or tape 114. Also, a control console 116 may be provided which is electrically connected to the appropriate components of the machine 20, such as the gear motor 55 and the cutting motor 57. In this manner, a worker could conveniently operate the machine 20 during a packaging session.

Figure 4:
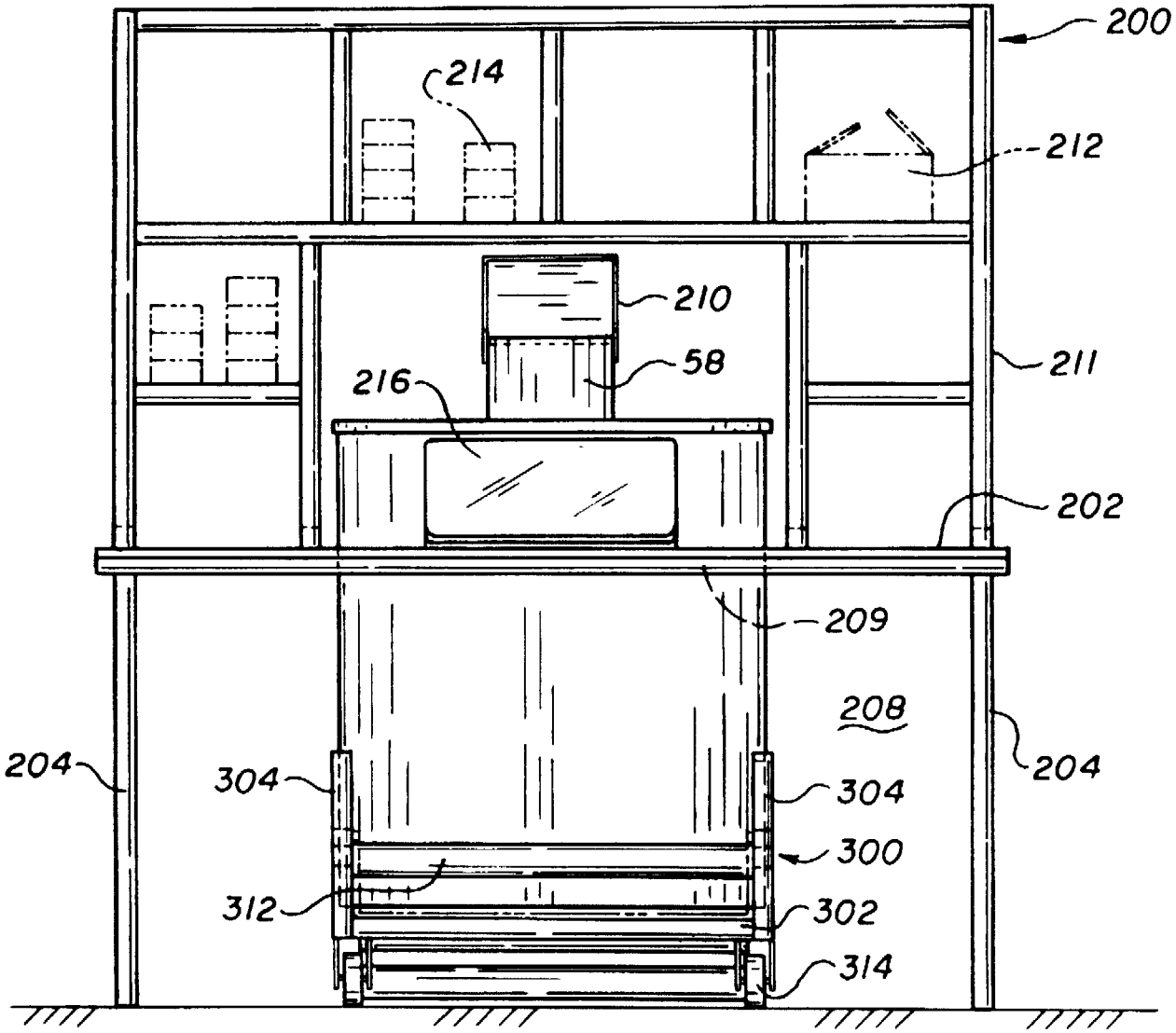
FIG. 4 is a front view of a dispensing table according to another embodiment of the present invention, the table being shown with a cushioning conversion machine mounted thereon in a vertical orientation and with a stock supply cart positioned adjacent thereto.
Figure 5:
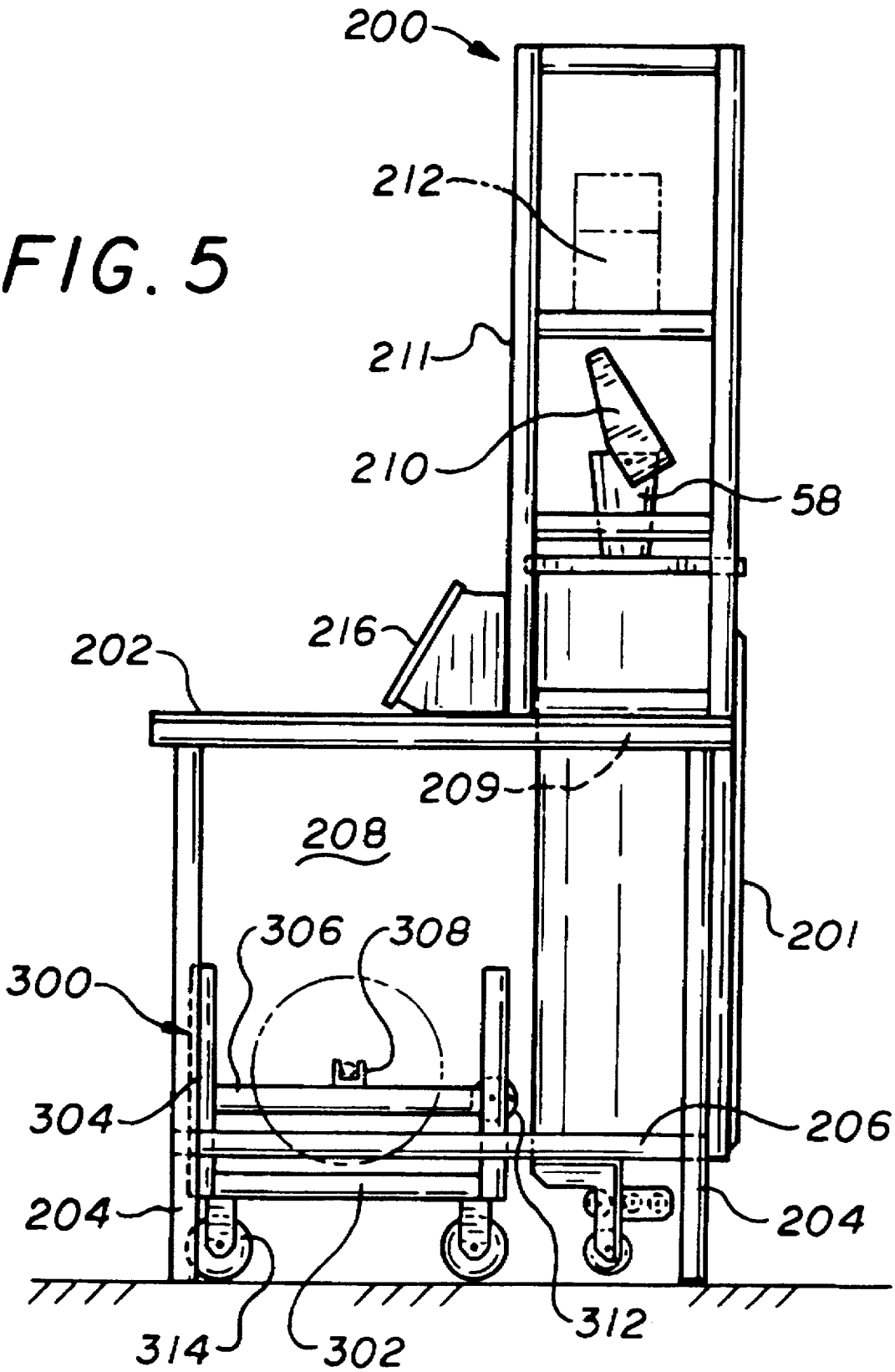
FIG. 5 is a side view of the dispensing table of the FIG. 4, the vertically mounted cushioning conversion machine, and the supply cart.

Referring now to FIGS. 4–5, a dispensing table 200 according to another embodiment of the present invention is shown. In this embodiment, a cushioning conversion machine 20 is mounted on the table 200 in a vertical orientation via a mounting brace 201. In other words, the machine frame 36 is positioned in a substantially vertical manner whereby an imaginary longitudinal line or axis from the upstream end to the downstream end would be substantially vertical.

The machine 20 is essentially identical to that shown in FIG. 1 except that it includes a modified form 50' of the stock supply assembly. Specifically, the stock supply assembly 50' includes two laterally spaced brackets 62'. The brackets 62' are each generally L-shaped and have a leg 65' extending perpendicularly outward from a flat connecting base wall 66'. The legs 65' cooperate to mount a sheet separator 74' and a constant-entry bar 80'. Thus, the stock supply assembly 50' does not include a pair of legs 64 which support the stock roll 21. Instead, as is explained in more detail below, a stock roll cart is provided for this purpose.

The table 200 includes a work platform 202 which is supported by a series of vertical and horizontal support members and which is at a convenient height for a worker performing packaging duties. As with the work platform 102 of the table 100, the height of the work platform 102 is preferably between two and five feet, and, more preferably, is approximately three feet.

The support members may be of a variety of forms provided that an appropriate cavity is provided just below the work platform 202 for the mounting of the machine 20. In the illustrated embodiment, the support members comprise four vertical support members 204 and two horizontal support members 206 which interconnect adjacent front/rear vertical support members 104. This arrangement of the support members provides a cavity 208 for the machine 20.

As is best seen in FIG. 5, the outer surface of the frame base plate 43 is generally aligned with the rear plane of the dispensing table 200. In this manner, the table 200 may be positioned against a wall if necessary or desired. One may appreciate that the basically "C" shape of the frame 36, and the flat uninterrupted outer surface of the frame base plate 43, allows such a mounting arrangement. Additionally, the sizing of the frame 36, and the arrangement of the cushioning assemblies thereon, allows the machine 20 to be mounted in this manner.

The work platform 202 includes an opening 209 through which a downstream portion of the cushioning conversion machine 20 extends. Thus, the post-cutting constraining assembly 58 extends above the work platform 202. In this manner, as a cut section emerges from the exit opening 61 of the post-cutting constraining assembly 58, it will be deposited on the work platform 102. A worker may then conveniently place the cut section in a shipping case, or box, to fill any voids and/or to cushion an item during the shipping process. A deflector 210 may be provided to encourage the cut section to be deposited on the appropriate portion of the work platform 202.

The table 200 may additionally include a shelf unit 211 mounted on a rear portion of the work platform 202. This shelf unit 211 may used to store appropriate packaging materials, such as boxes 212 and/or tape 214. Also, a control panel 216 may be provided which is electrically connected to the appropriate components of the machine 20, such as the gear motor 55 and the cutting motor 57. In this manner, a worker may conveniently operate the machine 20 during a packaging session.

As was indicated above, the stock supply assembly 50' does not include a pair of legs 64 which support the stock roll 21. Instead, a stock roll cart 300 is provided for this purpose. The stock roll cart 300 is similar to the cart 18 disclosed in U.S. Pat. 4,557,716, the entire disclosure of which is hereby incorporated by reference. This patent is assigned to the assignee of the present application.

Specifically, the stock roll cart 300 includes a support structure comprising a base plate 302, four upright members 304 which extend from the four corners of the base plate 302, and cross bars 306 which connect intermediate portions of the adjacent front/rear upright members 304. Aligned support brackets 308 are attached to the cross bars 306, and thus are coupled to the support structure.

The stock roll cart 300 additionally includes a support rod 310 which is cradled in open slots formed in the upper ends of each bracket 308. The supply rod 310 is designed to extend relatively loosely through the hollow tube 29 of the stock roll 21. A guide roll 312 may also be provided which extends between central portions of the front upright members 304. As the stock material 22 is pulled through the machine 20 by the gear assembly 54, the tube 29 will freely rotate thereby dispensing the stock material 22 which will then travel around the guide roll 312, around the constant-entry bar 80, and through the sheet separator 74.

The stock supply cart 300 may additionally include wheels 314 which are mounted to the bottom of the base plate 302 for facilitating the movement of the cart 300 into coating relationship with the cushioning conversion machine 20. In this manner, the cart 300 may be loaded with a roll 21 of stock material 22 at a remote location and then conveniently transferred to the table 200. As should be apparent, it is possible for the stock supply cart 300 to be loaded with a considerably larger stock roll 21 as compared to that which may be useable with the stock supply assembly 50.

One may now appreciate that the present invention provides a dispensing table for the cushioning conversion machine in which a cushioning product emerging from the machine will be deposited on a work platform. Although the invention has been shown and described with respect to certain preferred embodiments, it is obvious that equivalent alterations and modifications will occur to others skilled in the art upon the reading and understanding of this specification. The present invention includes all such equivalent alterations and modifications and is limited only by the scope of the following claims.

What is claimed is:

1. In combination, a dispensing table and a cushioning conversion machine;

said dispensing table including a substantially horizontal work platform;

said cushioning conversion machine including conversion assemblies which convert sheet-like stock material into a cushioning product;

said cushioning conversion machine including a frame having an upstream end and a downstream end, and a downstream end, said conversion assemblies being mounted on said frame;

said cushioning conversion machine being mounted to said table in such a manner that the cushioning product is deposited on said work platform during operation of said machine, said machine including an outlet through which the cushioning product emerges for deposit on said work platform, and said outlet being spaced above said work platform for deposit of the cushioning product onto said work platform from an elevated location;

said machine being mounted to said table in a substantially vertical orientation whereby an axis from said upstream end to said downstream end is substantially vertical;

said work platform including an opening through which a downstream portion of said cushioning conversion machine extends.

2. The combination of claim 1 wherein the height of said work platform is approximately three feet above floor level.

3. The combination of claim 1 wherein said frame includes a frame base plate, a first upstream frame end plate extending generally perpendicularly from an upstream end of said frame base plate and a second downstream frame end plate extending in substantially the same direction as said first frame end plate from a downstream end of said frame base plate and wherein an outer side of said frame base plate forms a smooth uninterrupted surface.

4. The combination of claim 3 wherein said frame end plates are approximately 4 inches wide and approximately 12 inches tall.

5. The combination of claim 1 wherein said dispensing table further comprises a control console electrically connected to said conversion assemblies.

6. The combination of claim 1 wherein said dispensing table further comprises a shelf unit for storing appropriate packaging materials.

7. The combination of claim 1 wherein said conversion assemblies comprise:

a forming assembly which is mounted on said frame intermediate said upstream end and said downstream end and which causes inward rolling of the lateral edges of the sheet-like material into a generally spiral-like form whereby a continuous unconnected strip having two lateral pillow-like portions separated by a thin central band is formed;

a stock supply assembly which is mounted on said frame upstream of said forming assembly and which supplies the stock material to said forming assembly; and a pulling/connecting assembly which is mounted on said frame downstream of said forming assembly and which pulls the stock material from said stock supply assembly through said forming assembly and connects the continuous unconnected strip along its central band whereby a coined strip of pad-like cushioning dunnage product is formed.

8. The combination of claim 7 wherein said conversion assemblies additionally include a cutting assembly which is mounted on said frame downstream of said pulling/connecting assembly and which cuts the coined strip into cut sections.

9. The combination of claim 8 wherein said conversion assemblies further include a post-cutting constraining assembly which is mounted on said frame downstream of said cutting assembly and which circumferentially constrains the cut sections.

10. The combination of claim 9 wherein said post-cutting constraining assembly includes an exit opening through which the cut sections emerge whereby said exit opening is the final outlet through which the cushioning product emerges.

11. The combination of claim 9 further comprising a deflector mounted adjacent said exit opening which encourages the cut section to be deposited on the appropriate portion of said work platform.

12. The combination of claim 7 wherein said stock supply assembly comprises a constant-entry bar.

13. The combination of claim 12 further comprising a stock supply cart positioned adjacent to said stock supply assembly of said cushioning conversion machine.

14. The combination of claim 13 wherein said stock supply cart comprises a support structure, rod-supporting brackets and a support rod for the sheet-like stock material;

said rod-supporting brackets being coupled to said support structure and having slots which cradle said support rod.

15. The combination of claim 14 wherein said stock supply cart further comprises wheels mounted to the bottom of said support structure.

16. The combination of claim 1 wherein the height of said work platform is between two and five feet above floor level.

* * * * *

UNITED STATES PATENT AND TRADEMARK OFFICE

CERTIFICATE OF CORRECTION

PATENT NO. : 5,637,071

DATED : June 10, 1997

INVENTOR(S) : James A. Simmons et al.

It is certified that error appears in the above-indentified patent and that said Letters Patent is hereby corrected as shown below:

In the Claims:

In column 8, line 27-28, delete the second "and a downstream end," between the first "and a downstream end" and "said conversion assemblies".

In column 8, line 56, "4 inches wide" should read --34 inches wide--.

Signed and Sealed this

Nineteenth Day of August, 1997

Bruce Lehman

*Attest:*

BRUCE LEHMAN

*Attesting Officer*

*Commissioner of Patents and Trademarks*